US009422777B2

(12) United States Patent
Foley et al.

(10) Patent No.: US 9,422,777 B2
(45) Date of Patent: Aug. 23, 2016

(54) ELEVATOR ASSEMBLY WITH REVERSIBLE INSERT

(71) Applicant: FOLEY PATENTS, LLC, Abbeville, LA (US)

(72) Inventors: Lawrence E. Foley, Lafayette, LA (US); Scott Foley, Abbeville, LA (US)

(73) Assignee: FOLEY PATENTS, LLC, Abbeville, LA (US)

( * ) Notice: Subject to any disclaimer, the term of this patent is extended or adjusted under 35 U.S.C. 154(b) by 0 days.

(21) Appl. No.: 14/738,029

(22) Filed: Jun. 12, 2015

(65) Prior Publication Data

US 2015/0361737 A1 Dec. 17, 2015

Related U.S. Application Data

(60) Provisional application No. 62/011,302, filed on Jun. 12, 2014.

(51) Int. Cl.
*E21B 19/06* (2006.01)

(52) U.S. Cl.
CPC ..... *E21B 19/06* (2013.01)

(58) Field of Classification Search
CPC ..... E21B 19/06
USPC ..... 294/90, 102.2, 119.2, 102.1, 106, 116
See application file for complete search history.

(56) References Cited

U.S. PATENT DOCUMENTS

| | | | | |
|---|---|---|---|---|
| 1,568,198 | A * | 1/1926 | Tschappat | E21B 33/0422 188/67 |
| 2,245,938 | A * | 6/1941 | Ratigan | E21B 19/06 294/90 |
| 2,259,054 | A * | 10/1941 | Young | E21B 3/04 175/423 |
| 5,009,289 | A * | 4/1991 | Nance | E21B 33/062 188/67 |
| 7,866,721 | B2 * | 1/2011 | Hollin | E21B 19/06 294/102.2 |
| 8,496,280 | B2 * | 7/2013 | Pietras | E21B 19/06 294/106 |
| 9,175,527 | B2 * | 11/2015 | McIntosh et al. | E21B 19/06 |
| 9,206,655 | B2 * | 12/2015 | Sipos | E21B 19/06 |
| 2013/0011221 | A1 * | 1/2013 | Mcintosh | E21B 19/06 414/22.51 |
| 2015/0021050 | A1 * | 1/2015 | Foley | E21B 19/06 166/385 |

* cited by examiner

*Primary Examiner* — Paul T Chin
(74) *Attorney, Agent, or Firm* — Ted M. Anthony

(57) ABSTRACT

An elevator assembly such as, for example, a single joint elevator apparatus having a removable load supporting insert member for gripping the outer surface of a pipe section. The load supporting insert member has at least two different shoulder profiles; the load supporting insert member can be quickly and easily removed, inverted and re-installed to accommodate and facilitate gripping of pipe sections having different outer configurations (including, without limitation, outer configurations associated with threaded connection members).

9 Claims, 9 Drawing Sheets

ELEVATOR ASSEMBLY WITH REVERSIBLE INSERT

CROSS REFERENCES TO RELATED APPLICATION

Priority of U.S. provisional patent application Ser. No. 62/011,302, filed Jun. 12, 2014, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF INVENTION

1. Field of the Invention

The present invention pertains to a pipe elevator assembly, primarily for use in the oil and gas drilling industry. More particularly, the present invention pertains to an elevator assembly having a reversible inner insert member that permits said elevator assembly to grip and accommodate multiple different types and configurations of pipe and/or threaded connections.

2. Brief Description of the Prior Art

In the oil well drilling industry, an elevator assembly (sometimes also referred to as a "set of elevators") is a mechanism that can be used to lift and support pipe and/or other tubular members. The elevator assembly, which is typically suspended from a rig's traveling block or other hoisting device using bails or linkages, is typically used to grip the external surface of pipe other tubular goods to be lifted within a drilling rig derrick. Once the elevator assembly is securely locked in place around the external surface of the pipe, the traveling block or other hoisting device can be raised in order to lift such pipe within a rig derrick and/or lower such pipe into a wellbore.

Although elevator assemblies come in many different shapes, sizes and configurations, one common style of elevator assembly is a latching-type elevator. Such an elevator generally comprises two opposing semi-cylindrical body members that are hingedly attached to each other; said members can be selective latched in a closed (joined) configuration, or unlatched in an open or spread apart configuration.

When unlatched, said opposing body members can be spread apart or swung open relative to each other to permit placement of such elevator body members around the outer or external surface of a section of pipe. When latched, said hinged opposing members can be temporarily locked together in mating relationship to form a ring-like load bearing structure that can be used to securely grip against the external surface of a section of pipe.

When multiple pipe sections are screwed together or otherwise joined to form an elongate pipe string, an elevator assembly can be used to grip an uppermost pipe section of the string and support the entire weight of such pipe string. In such cases, an elevator assembly typically must be capable of supporting relatively heavy loads, since such pipe strings can often be quite heavy. However, in certain instances, elevator assemblies are used to grip and support single pipe sections or very short pipe strings; in such cases, so-called single joint elevators are particularly useful for gripping and hoisting relatively light pipe sections.

Such single joint elevator assemblies, which are frequently smaller and lighter than conventional elevator assemblies, typically comprise removable components known as inserts; a separate insert is disposed on the inner surface of each opposing elevator member. Such inserts cooperate to form a desired profile that generally conforms to the shape of the outer surface of the particular section of pipe to be gripped by said elevator assembly. Further, such inserts each typically define at least one upwardly facing load-bearing shoulder or support surface designed to support the weight of a pipe section (and, more specifically, typically the lower surface of a threaded connection or threaded collar of such pipe section) to be gripped and lifted by said elevators. Elevator inserts are typically removable so that a single elevator assembly can be used with multiple sets of interchangeable inserts in order to fit many different types of pipe, or tubular goods having different outer profiles.

Thus, in order to function properly, a single set of opposing inserts must cooperate in order to closely conform to the outer surface of a particular type or style of pipe (including, without limitation, any integral threaded connection member or threaded collar). As such, a single set of inserts that conforms to one particular type of pipe section may not conform to another type of pipe section having a different outer configuration. For example, a single set of conventional elevator inserts designed for use with coupled pipe (that is, externally threaded pipe sections joined using internally threaded pipe couplings) will not work with pipe equipped with so-called premium or integrally formed threaded connections, and vice versa.

Thus, there is a need for an elevator system having interchangeable inserts. Said inserts should be quickly and efficiently removed and replaced. Further, such inserts should be compatible with multiple different styles or configurations of pipe.

SUMMARY OF INVENTION

In a preferred embodiment, the present invention comprises an elevator assembly (including, without limitation, as single-joint elevator assembly) having removable inner insert members. As with conventional elevator inserts, the insert members of the present invention are replaceable and can be selectively removed from elevator body members and replaced in order to accommodate various pipe sizes and configurations. However, unlike conventional elevator inserts, a single set of inner insert members of the present invention can accommodate multiple pipe sizes and/or configurations.

Each elevator insert of the present invention defines a first pipe profile in a first axial direction, and a second pipe profile in a second axial direction. Thus, when a mating pair of inserts of the present invention is installed in one direction, said inserts can accommodate one size or style of pipe (including, without limitation, one size or type of threaded connection). However, when said inserts are removed, inverted ("flipped") and reinstalled, the same set of inserts can also accommodate a different size or style of pipe (including, without limitation, a threaded connection). By way of illustration, but not limitation, when installed in an elevator assembly in a first direction, a single set of inserts of the present invention can grip and support a section of coupled pipe (for example, 2-⅜" 8-round tubing having threaded collars between joints). When such inserts are removed, inverted and reinstalled, the same set of inserts can also accommodate a section of pipe having premium or integrally formed threaded connections (such as, for example, so-called "CS-Hydril" threads).

BRIEF DESCRIPTION OF DRAWINGS

The foregoing summary, as well as any detailed description of the preferred embodiment, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
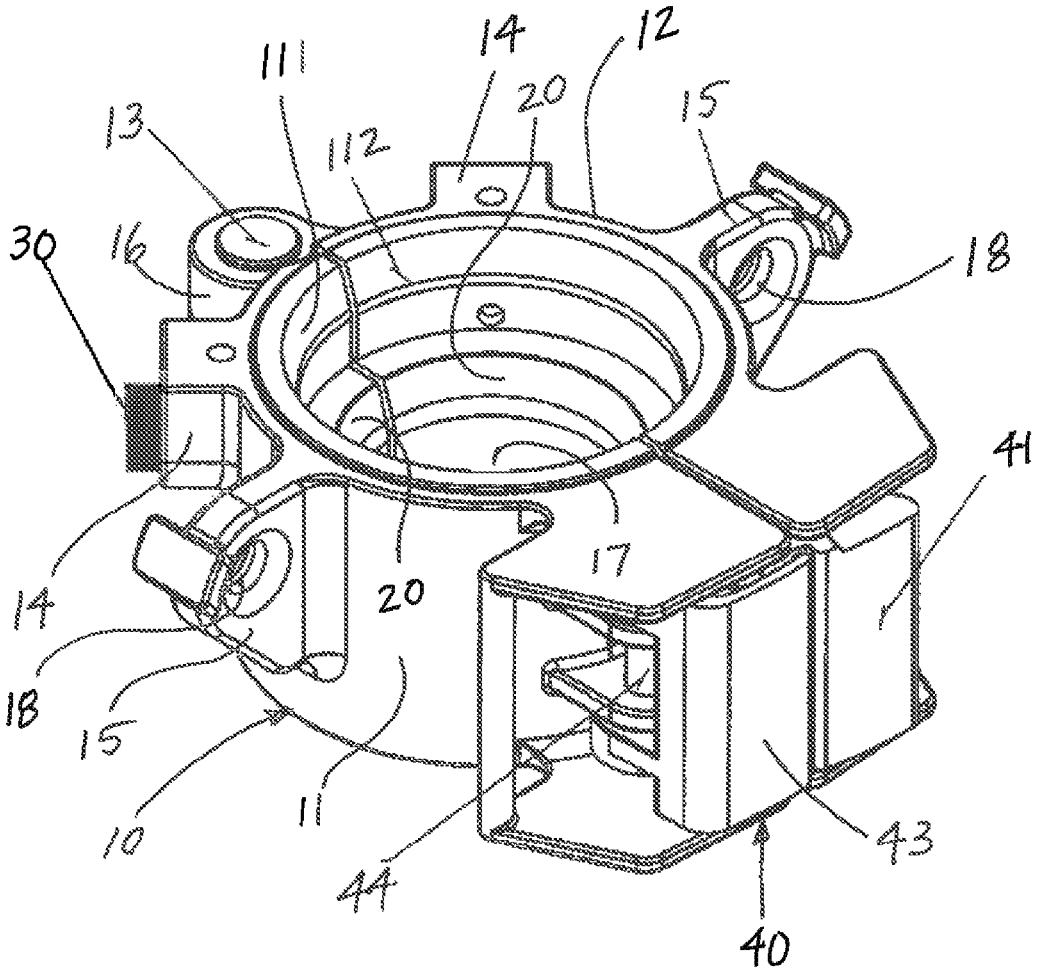
FIG. 1 depicts a side perspective view of an elevator assembly of the present invention in a closed and latched configuration.

FIG. 1 depicts a side perspective view of an elevator assembly 10 of the present invention in a closed and latched configuration. As depicted in FIG. 1, said elevator assembly 10 generally comprises first semi-cylindrical body member 11 having inner surface 111 and opposing second semi-cylindrical body member 12 having inner surface 112. Said first body member 11 and second body member 12 are hingedly attached to each other using hinge pin 13 that is disposed through hinge body 16. In a closed configuration depicted in FIG. 1, said first body member 11 and second body member 12 cooperate to form a substantially circular inner through bore 17.

Said opposing first and second members can be selectively latched in a closed (joined) configuration, or unlatched in an open configuration, using latch assembly 40. In a preferred embodiment depicted in FIG. 1, latch assembly 40 includes safety latch 41 having a lug member (not visible in FIG. 1) that can releasably mate with latch receptacle 43, which is pivotally mounted on latch pin 44.

Still referring to FIG. 1, said elevator assembly 10 also comprises lateral lifting eyelet members 15, each having an aperture 18. Elevator assembly 10 can be operationally attached to a top drive unit or other hoisting apparatus (such as, for example, a traveling block of a drilling rig) using conventional bails or other linkage members disposed through said apertures 18 and operationally attached to said elevator assembly 10 using said lifting eyelet members 15.

Opposing first body member 11 and second body member 12 each further comprise retainer pin receptacles 14. A retainer pin 30 is disposed through a transverse bore extending through each of said retainer pin receptacles 14. Pipe supporting insert members 20 are disposed along opposing inner arcuate surface 111 of first body member 11 and inner arcuate surface 112 of second body member 12.

Figure 2:
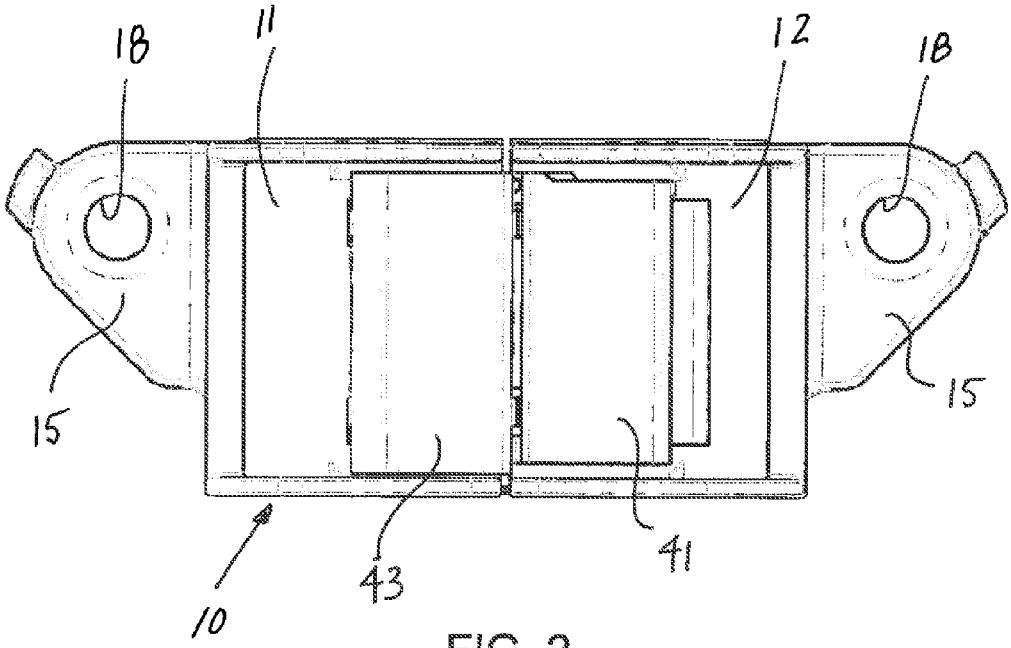
FIG. 2 depicts a side view of an elevator assembly of the present invention.

FIG. 2 depicts a side view of an elevator assembly 10 of the present invention in a closed position. Elevator assembly 10 generally comprises first semi-cylindrical body member 11 and opposing second semi-cylindrical body member 12 hingedly attached to each other. Said first and second body members are selectively connected using safety latch 41 that can releasably mate with latch receptacle 43. Lateral lifting eyelet members 15 having apertures 18 extend from the sides of said first body member 11 and second body member 12. Eyelet members 15 provide an attachment means for mounting elevator assembly 10 to a top drive unit or other hoisting assembly (such as, for example, a traveling block of a drilling rig) using conventional bails or other linkage members.

Figure 3:
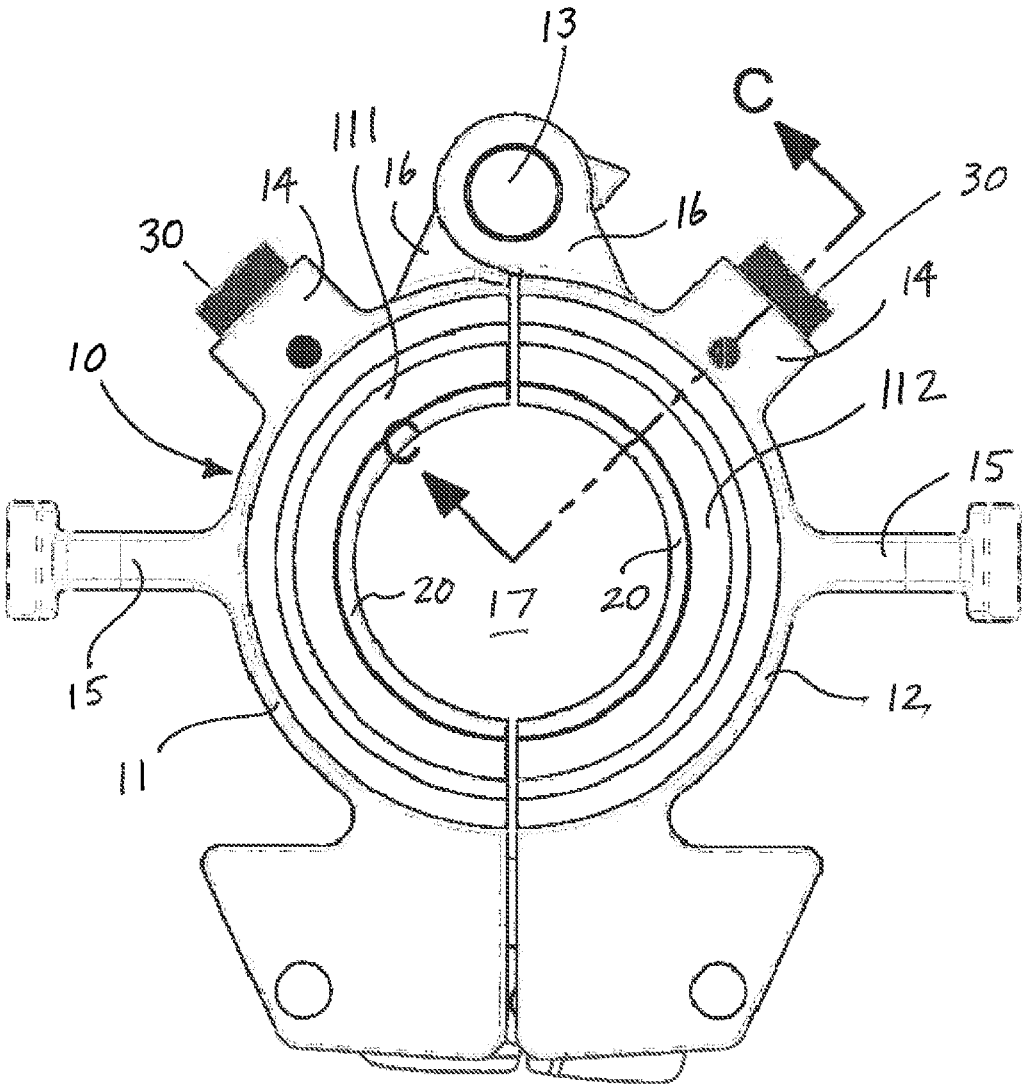
FIG. 3 depicts an overhead view of an elevator assembly of the present invention.

FIG. 3 depicts an overhead view of elevator assembly 10 of the present invention. Elevator assembly 10 generally comprises first semi-cylindrical body member 11 having inner surface 111 and opposing second semi-cylindrical body member 12 having inner surface 112 that are hingedly attached using hinge pin 13 disposed through hinge body 16. In a closed configuration depicted in FIG. 3, said first body member 11 and second body member 12 cooperate to form a substantially circular inner through bore 17. Said elevator assembly 10 also comprises lateral lifting eyelet members 15.

Opposing first body member 11 and second body member 12 each further comprise retainer pin receptacles 14, each having a transverse bore extending therethrough. A retainer pin 30 is disposed through each of said transverse bores extending through said retainer pin receptacles 14. Pipe supporting insert members 20 are disposed along opposing inner arcuate surface 111 of first body member 11 and inner arcuate surface 112 of second body member 12.

Figure 4:
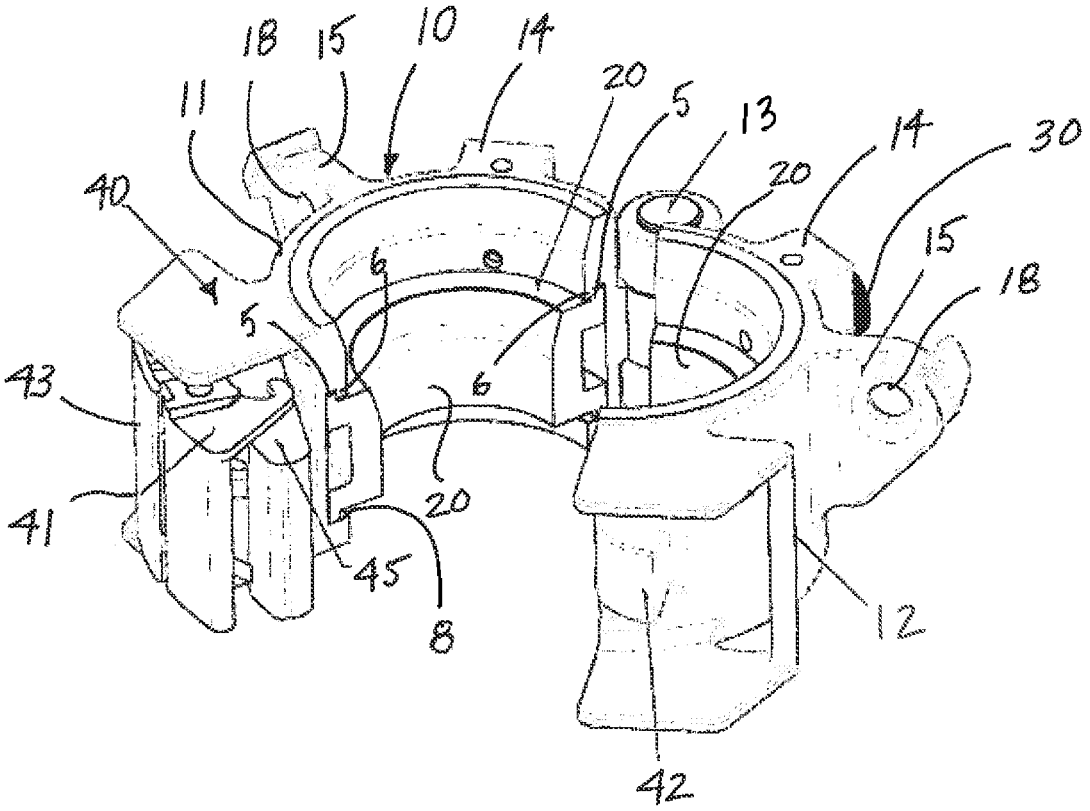
FIG. 4 depicts a side perspective view of an elevator assembly of the present invention in an open and substantially spread apart configuration.

FIG. 4 depicts a side perspective view of an elevator assembly 10 of the present invention in an open and substantially spread apart configuration. As depicted in FIG. 4, when unlatched, opposing body members 11 and 12 can pivot about hinge pin 13, and can be spread apart or swung open relative to each other in order to permit placement of said opposing body members 11 and 12 around the outer or external surface of a section of pipe.

After said spread apart opposing body members 11 and 12 are placed in a desired position relative to the external surface of a section of pipe, said opposing first and second members can be closed (again, by pivoting about hinge pin 13) and selectively latched in a closed (joined) configuration using a latch assembly 40 generally comprising safety latch 41 on clasp member 45. When oriented in a closed latched and secure configuration, lug 42 can be received by said clasp member 45 and safety latch 41.

Elevator assembly 10 also comprises lateral lifting eyelet members 15, each having an aperture 18, as well as retainer pin receptacles 14. A retainer pin 30 is disposed through a transverse bore extending through each of said retainer pin receptacles 14. Pipe supporting insert members 20 are disposed along opposing inner arcuate surface 111 of first body member 11 and inner arcuate surface 112 of second body member 12. When closed and latched, said hinged opposing members 11 and 12 can be temporarily secured together in mating relationship to form a ring-like load bearing structure that can be used to securely grip against the external surface of a section of pipe.

Figure 5:
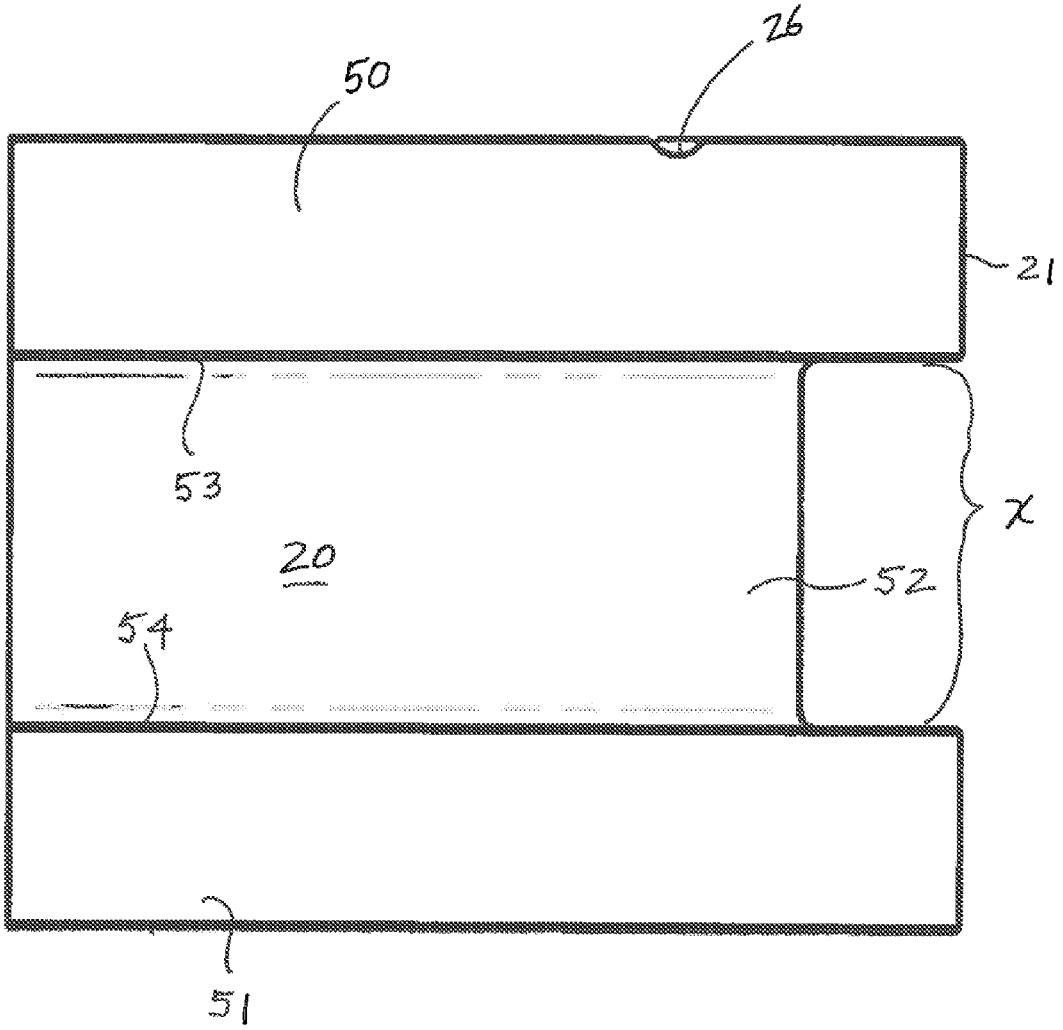
FIG. 5 depicts a side view of an insert member of the present invention.
Figure 6:
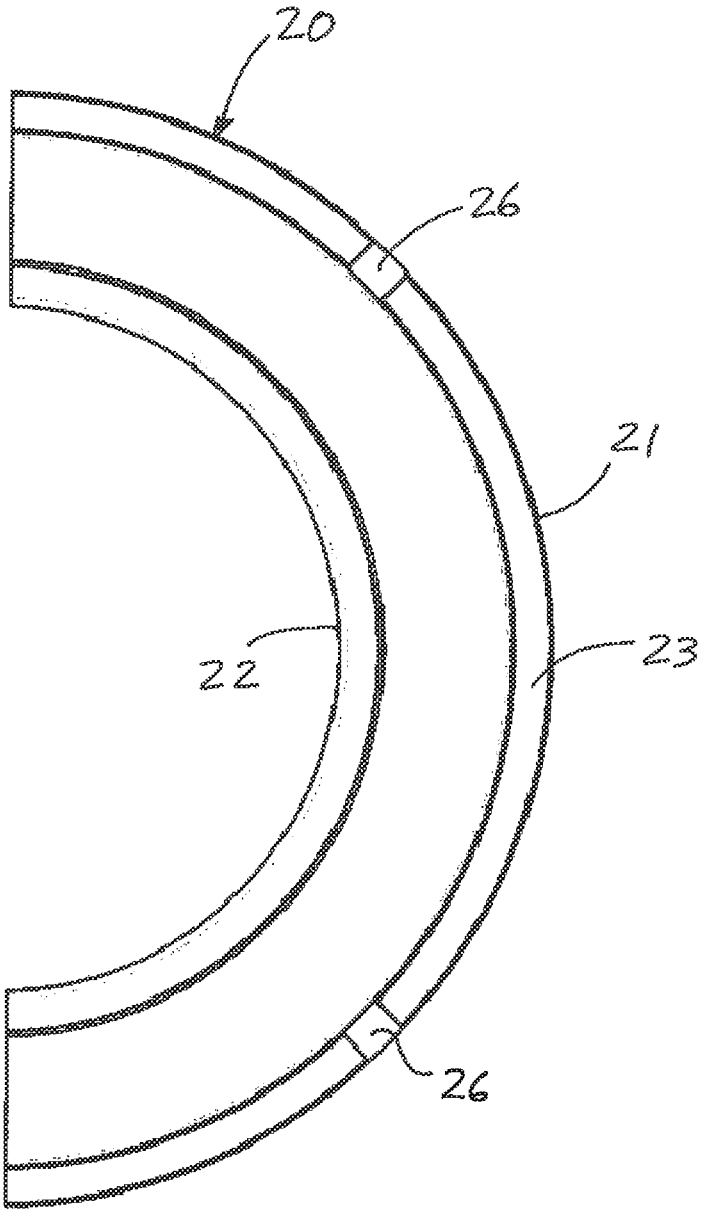
FIG. 6 depicts an overhead view of an insert member of the present invention.

FIG. 5 depicts a side view of an external surface of an insert member 20 of the present invention, while FIG. 6 depicts an overhead view of said insert member 20 of the present invention. Referring to FIG. 6, said insert member 20 has a substantially semi-cylindrical shape defining a curved outer surface 21 and curved inner surface 22. In a preferred embodiment, outer surface 21 has a radius of curvature substantially equivalent to that of inner surface 111 of first body member 11 and inner surface 112 of second body member 12. Further, inner surface 22 has a radius of curvature substantially equivalent to a section of pipe to be gripped by elevator assembly 10; thus, when two insert members 20 are joined in opposing relationship to form a substantially circular structure, opposing inner surfaces 22 of said insert members cooperate to form an opening having an inner diameter substantially equivalent to the outer diameter of a section of pipe to be gripped by elevator assembly 10.

Still referring to FIG. 6, insert member 20 further comprises first circumferential outer rim member 23 and first load shoulder surface 24. At least one retention pin receiving groove 26 is formed in said first outer rim member 23. In a preferred embodiment, said at least one retention pin receiving groove 26 is oriented radially inward relative to semi-cylindrical insert member 20.

Referring to FIG. 5, outer surface 21 is formed by first flange extension member 50, second flange extension member 51 and inner member 52 extending between said first and second flange extension members. Said components cooperate to form a circumferential groove or recess "x" between said first flange extension member 50 and second flange extension member 51, and define first load shoulder 53 and second load shoulder 54 on either side of said groove or recess. At least one retention pin receiving groove 26 is formed on the upper surface of first flange extension member 50 (which corresponds with outer rim member 23 depicted in FIG. 6).

Figure 7:
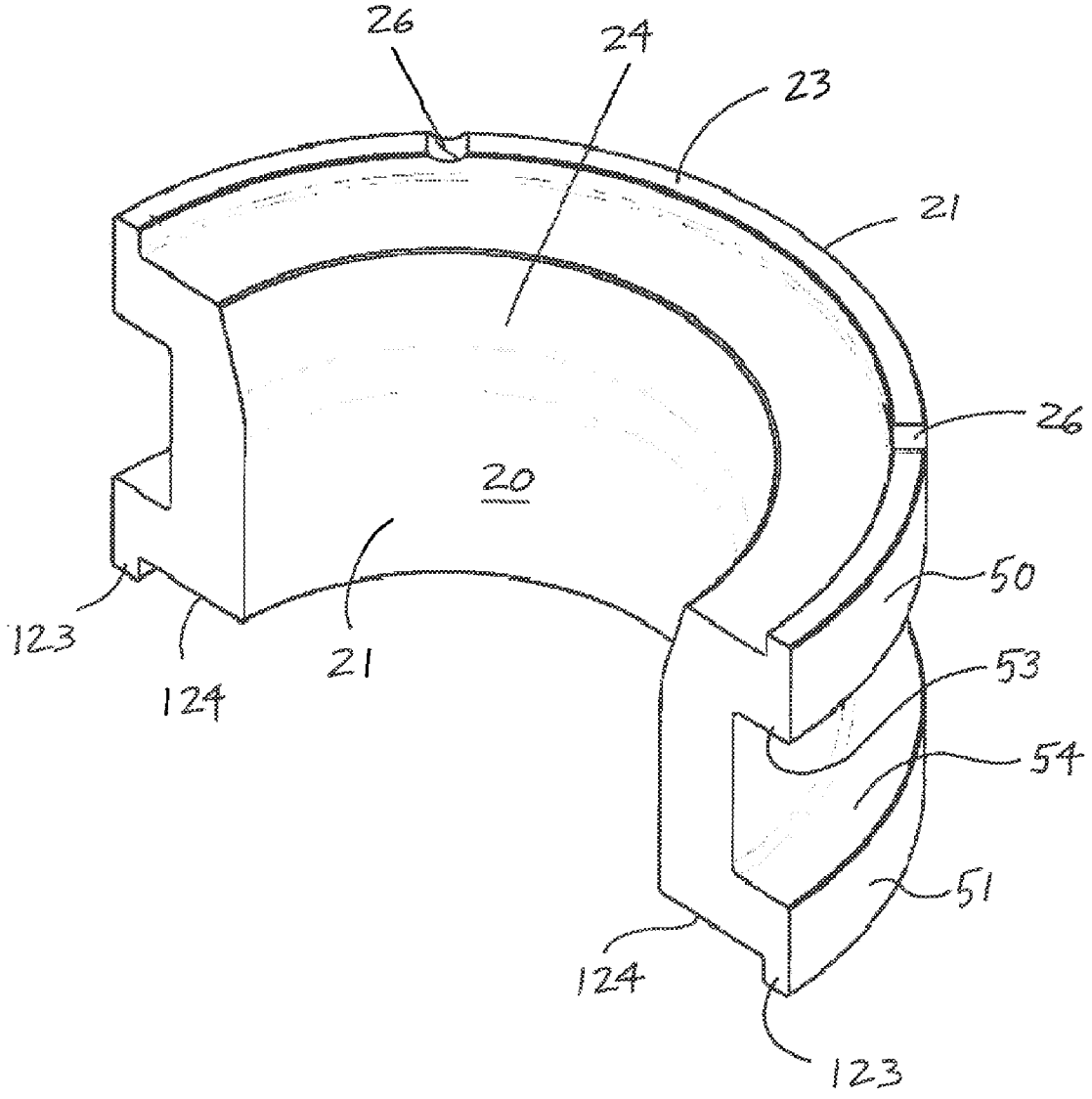
FIG. 7 depicts a side perspective view of an insert member of the present invention.

FIG. 7 depicts a side perspective view of an insert member 20 of the present invention. Insert member 20 has a substantially semi-cylindrical shape defining a curved outer surface 21 and curved inner surface 22. As previously noted, outer surface 21 has a radius of curvature substantially equivalent to that of inner surface 111 of first body member 11 and inner surface 112 of second body member 12 (see FIG. 1), while inner surface 22 has a radius of curvature substantially equivalent to that of a section of pipe to be gripped by elevator assembly 10.

First circumferential outer rim member 23 and first inner load shoulder surface 24 are formed at the upper end surface of insert member 20, while second circumferential outer ring member 123 and second inner load shoulder 124 are formed on the opposite lower end surface of said insert member 20 (when insert member 20 is oriented as shown in FIG. 7). In the embodiment depicted in FIG. 7, first inner load shoulder surface 24 has at least one tapered surface, while second inner load shoulder 124 defines a substantially flat or planar surface.

Outer surface 21 is formed by first flange extension member 50, second flange extension member 51 and inner surface 52 extending between said first and second flange extension members. A circumferential groove or recess is formed between said first flange extension member 50 and second flange extension member 51, which cooperate to define first load shoulder 53 and second load shoulder 54 on either side of said groove or recess. At least one retention pin receiving groove 26 is formed on the upper surface of first flange extension member through first outer rim member 23.

Figure 8:
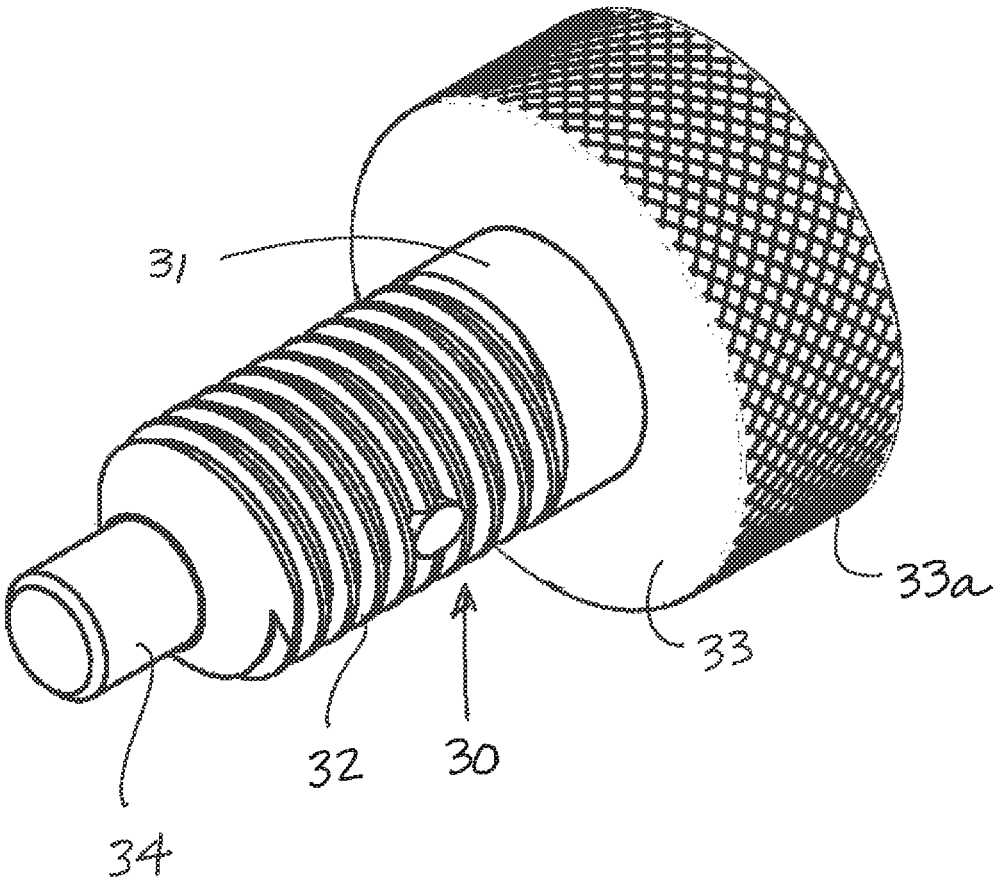
FIG. 8 depicts a side perspective view of a retainer pin of the present invention.

FIG. 8 depicts a side perspective view of a retainer pin 30 of the present invention. In a preferred embodiment, said retainer pin 30 comprises body member 31 having external threads 32. Head 33 having a friction promoting surface 33*a* for gripping is disposed at one end of said body member 31, while cylindrical extension 34 is disposed at the opposite end of said body member 31.

Referring back to FIG. 4, it is to be observed that an insert member 20 can be removably mounted to each of said first body member 11 and second body member 12. Specifically, a groove or slot 5 defining retention shoulder 6 is formed along the inner surface of first body member 11. Although not visible in FIG. 4, a similar slot and retention shoulder are also formed along the inner surface of second body member 12. First circumferential outer rim member 23 is received within said slot 5 and held in place against radial movement by retention shoulder 6, while second circumferential outer ring member 123 is supported on support surface 8. Unless restrained from rotational movement, it is to be observed that insert member 20 can be easily mounted to body member 11, and selectively removed from said body member 11.

Figure 9:
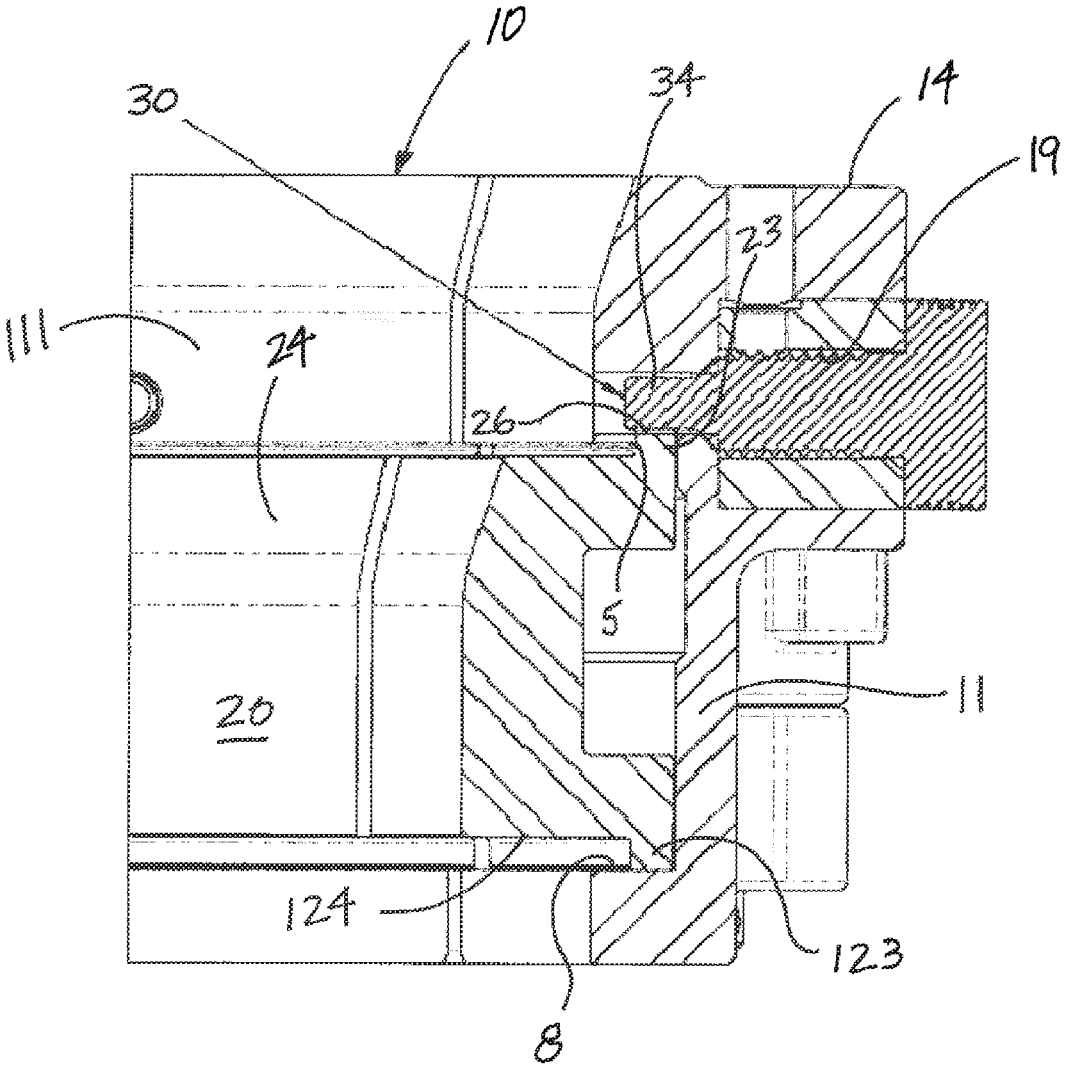
FIG. 9 depicts a side sectional view of an elevator assembly along line C-C of FIG. 3.

FIG. 9 depicts a side sectional view of an elevator assembly 10 along line C-C of FIG. 3. Body member 11 has retainer pin receptacle 14 having a transverse bore 19. A retainer pin 30 is disposed through said transverse bore 19 extending through retainer pin receptacle 14. Pipe supporting insert member 20 is disposed along inner arcuate surface 111 of body member 11.

Retention shoulder 6 is formed along the inner surface of body member 11. First circumferential outer rim member 23 is held in place against radial movement by said retention shoulder 6, while second circumferential outer ring member 123 is disposed on support surface 8. Cylindrical extension 34 is at least partially received within a retention pin groove 26 to prevent rotational movement of insert member 20 relative to body member 11.

In a preferred embodiment, the present invention comprises elevator assembly 10 (which can be, but is not limited to, a single-joint elevator assembly) having removable inner insert members 20. Insert members 20 of the present invention are replaceable and can be selectively removed from elevator body members and replaced in order to accommodate various pipe sizes and configurations. Unlike conventional elevator inserts, a single set of inner insert members 20 of the present invention can accommodate multiple pipe sizes and/or configurations.

Each elevator insert 20 of the present invention defines a first internal load shoulder 24 profile in a first axial direction, and a second internal load shoulder 124 profile in a second axial direction. Thus, when a mating pair of inserts 20 of the present invention is installed in one direction, first internal load shoulder profiles (which are identical or substantially similar to each other) match in a first axial direction, and second internal load shoulder profiles (which are identical or substantially similar to each other) match in a second axial direction. Said mating inserts, and their matching first load supporting shoulders, can accommodate a first size or style of pipe (including, without limitation, one size or type of threaded connection). However, when said inserts are removed, inverted ("flipped") and reinstalled, the same set of mating inserts, and their matching first load supporting shoulders, can also accommodate a different size or style of pipe (including, without limitation, a threaded connection).

By way of illustration, but not limitation, when installed in an elevator assembly in a first direction, a single set of inserts of the present invention can grip and support a section of coupled pipe (for example, 2-⅜" 8-round tubing having threaded collars between joints) using second internal load shoulder 124; in this configuration, said collar can be disposed on and supported by substantially flat or planar load shoulder 124 that is oriented substantially perpendicular to the longitudinal axis of a section of pipe to be gripped by said elevator assembly. When such inserts are removed, inverted and reinstalled, the same set of inserts can also accommodate a section of pipe having premium or integrally formed threaded connections (such as, for example, so-called "CS-Hydril" threads) using first internal shoulder 24; in this configuration, the tapered outer shape of said connection can be disposed on and supported by tapered load shoulder 24. It is to be observed that other load shoulder shapes, configurations or dimensions can be envisioned to accommodate and mate with other types or sizes of pipe and/or connections.

As such, a single set of elevator inserts of the present invention can be used to grip and lift multiple sections of pipe having markedly different outer profiles or threaded connections. The design of the present invention promotes efficiency and versatility of elevator assemblies equipped to use such inserts. Further, fewer total elevator inserts are required to be transported to, and stored at, drilling rigs or other installations, which can be particularly important for work sites situated in remote locations, such as offshore platforms or marine drilling vessels.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An elevator assembly for gripping a section of pipe comprising:

a) a first body member having an inner surface;

b) a second body member having an inner surface, wherein said second body member is operationally attached to said first body member;

c) a first pipe gripping insert removeably mounted to said inner surface of said first body member, wherein said first pipe gripping insert further comprises;

an inner surface adapted to contact said section of pipe, wherein said inner surface of said first pipe gripping insert defines a first upwardly facing load shoulder and a second downwardly facing load shoulder;

d) a second pipe gripping insert removeably mounted to said inner surface of said second body member, wherein said second pipe gripping insert further comprises an inner surface adapted to contact said section of pipe, wherein said inner surface of said second pipe gripping insert defines a second upwardly facing load shoulder and a second downwardly facing load shoulder.

2. The elevator assembly of claim 1, wherein said first load shoulder comprises a tapered surface.

3. The elevator assembly of claim 1, wherein said second load shoulder comprises a substantially flat surface oriented substantially perpendicular to the longitudinal axis of a section of pipe gripped by said elevator assembly.

4. The elevator assembly of claim 1, wherein said first and second body members are hingedly connected.

5. The elevator assembly of claim 4, wherein said first and second body members can be selectively shifted between a first open position and a second substantially closed position.

6. The elevator assembly of claim 1, wherein said first body member further comprises a first elongate slot along substantially the entire width of said inner surface, and said first pipe gripping insert is disposed in said first elongate slot.

7. The elevator assembly of claim 1, wherein said second body member further comprises a second elongate slot along substantially the entire width of said inner surface, and said second pipe gripping insert is disposed in said second elongate slot.

8. The elevator assembly of claim 1, wherein said first and second upwardly facing load shoulders are adapted to cooperate to grip a section of pipe having a first connection member.

9. The elevator assembly of claim 1, wherein said first and second downwardly facing load shoulders are adapted to cooperator to grip a section of pipe having a second connection member.

* * * * *